US009671724B2

(12) United States Patent
Nakaegawa et al.

(10) Patent No.: US 9,671,724 B2
(45) **Date of Patent: *Jun. 6, 2017**

(54) IMAGE FORMING APPARATUS

(71) Applicant: CANON KABUSHIKI KAISHA, Tokyo (JP)

(72) Inventors: Tohru Nakaegawa, Nagareyama (JP); Masanori Shida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/986,959

(22) Filed: Jan. 4, 2016

(65) Prior Publication Data

US 2016/0116866 A1 Apr. 28, 2016

Related U.S. Application Data

(60) Division of application No. 14/505,724, filed on Oct. 3, 2014, now Pat. No. 9,274,477, which is a continuation of application No. PCT/JP2013/060761, filed on Apr. 3, 2013.

(30) Foreign Application Priority Data

Apr. 3, 2012 (JP) ..... 2012-084974
Apr. 3, 2012 (JP) ..... 2012-085031

(51) Int. Cl.
*G03G 15/16* (2006.01)
*G03G 15/01* (2006.01)
*G03G 15/00* (2006.01)

(52) U.S. Cl.
CPC ..... *G03G 15/1665* (2013.01); *G03G 15/0189* (2013.01); *G03G 15/161* (2013.01); *G03G 15/1605* (2013.01); *G03G 15/1675* (2013.01); *G03G 15/5004* (2013.01); *G03G 2215/0132* (2013.01)

(58) Field of Classification Search
CPC combination set(s) only.
See application file for complete search history.

(56) References Cited

U.S. PATENT DOCUMENTS 5,099,286 A 3/1992 Nishise et al.
6,294,305 B1 9/2001 Kobayashi et al.
6,421,521 B2 7/2002 Tanaka
6,618,565 B2 9/2003 Tamiya et al.
(Continued)

FOREIGN PATENT DOCUMENTS

JP 2001-175092 6/2001
JP 2001-255761 9/2001
(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

In a constitution of primary-transfer-high-voltage-less in which a power source dedicated to primary-transfer, in the case where voltage applications for determining primary-transfer and secondary-transfer voltages are carried out concurrently, there is a possibility of improper primary-transfer. The possibility is decreased by controlling a power source so that a voltage drop of a Zener diode maintains a Zener breakdown voltage.

13 Claims, 10 Drawing Sheets

(56) References Cited

U.S. PATENT DOCUMENTS

| | | | | |
|---|---|---|---|---|
| 6,829,450 | B2 | 12/2004 | Tamiya et al. | |
| 7,751,737 | B2 | 7/2010 | Ishida et al. | |
| 8,265,499 | B2 | 9/2012 | Sueoka | |
| 8,532,514 | B2 | 9/2013 | Shida | |
| 8,634,737 | B2 | 1/2014 | Nakaegawa | |
| 9,274,477 | B2 * | 3/2016 | Nakaegawa | G03G 15/0189 |
| 2001/0031160 | A1 | 10/2001 | Tanaka | |
| 2001/0051056 | A1 | 12/2001 | Noguchi et al. | |
| 2005/0232663 | A1 * | 10/2005 | Shimura | G03G 15/161 399/315 |
| 2009/0080923 | A1 | 3/2009 | Murayama | |
| 2013/0188980 | A1 | 7/2013 | Ito et al. | |
| 2015/0023679 | A1 | 1/2015 | Nakaegawa et al. | |
| 2015/0023680 | A1 | 1/2015 | Nakaegawa et al. | |
| 2015/0023681 | A1 | 1/2015 | Shida | |
| 2015/0093133 | A1 | 4/2015 | Nakaegawa et al. | |

FOREIGN PATENT DOCUMENTS

| | | | |
|---|---|---|---|
| JP | 2001-265135 | | 9/2001 |
| JP | 2001255761 | A | 9/2001 |
| JP | 2003-035986 | | 2/2003 |
| JP | 2003-280331 | | 10/2003 |
| JP | 2004-117920 | | 4/2004 |
| JP | 2006-259640 | | 9/2006 |
| JP | 2006259640 | A | 9/2006 |
| JP | 2010-191276 | | 9/2010 |
| JP | 2011-039428 | | 2/2011 |
| JP | 2012-098709 | | 5/2012 |
| RU | 2 372 635 | | 7/2008 |
| WO | 2012/046824 | | 4/2012 |

* cited by examiner

IMAGE FORMING APPARATUS

This application is a divisional of application Ser. No. 14/505,724 filed Oct. 3, 2014, which in turn is a continuation of PCT Application No. PCT/JP2013/060761 filed Apr. 3, 2013, which claims benefit of Japanese Patent Application No. 2012-084974 and Japanese Patent Application No. 2012-085031, both filed Apr. 3, 2012.

TECHNICAL FIELD

The present invention relates to an image forming apparatus using an electrophotographic type, such as a copying machine, a printer or the like.

BACKGROUND ART

In an electrophotographic type image forming apparatus, in order to meet various recording materials, an intermediary transfer type is known, in which a toner image is transferred from a photosensitive member onto an intermediary transfer member (primary-transfer) and then is transferred from the intermediary transfer member onto the recording material (secondary-transfer) to form an image.

Japanese Laid-open Patent Application 2003-35986 discloses a conventional constitution of the intermediary transfer type. More particularly, in Japanese Laid-open Patent Application 2003-35986, in order to primary-transfer the toner image from the photosensitive member onto the intermediary transfer member, a primary-transfer roller is provided, and a power source exclusively for the primary-transfer is connected to the primary-transfer roller. Furthermore, in Japanese Laid-open Patent Application 2003-35986, in order to secondary-transfer the toner image from the intermediary transfer member onto the recording material, a secondary-transfer roller is provided, and a voltage source exclusively for the secondary-transfer is connected to the secondary-transfer roller.

In Japanese Laid-open Patent Application 2006-259640, there is a constitution in which a voltage source is connected to an inner secondary-transfer roller, and another voltage source is connected to the outer secondary-transfer roller. In Japanese Laid-open Patent Application 2006-259640, there is description to the effect that the primary-transfer of the toner image from the photosensitive member onto the intermediary transfer member is effected by voltage application to the inner secondary-transfer roller by the voltage source.

SUMMARY OF THE INVENTION

Problem to be Solved by Invention

However, when the voltage source exclusively for the primary-transfer is provided, there is a liability that it leads to an increase in cost, so that a method for omission of the voltage source exclusively for the primary-transfer is desired.

A constitution in which a voltage source exclusively for the primary-transfer is omitted, and the intermediary transfer member is grounded through a constant-voltage element to produce a predetermined primary-transfer voltage, has been found.

However, in the above constitution, there is a problem that in the case where timing of the primary-transfer and timing of application of a voltage to the secondary-transfer member for determining a secondary-transfer voltage are overlapped, the primary-transfer voltage is lower than a predetermined voltage to generate a primary-transfer defect when a test voltage to be applied is low.

Means for Solving Problem

The present invention provides an image forming apparatus includes: an image bearing member for bearing a toner image; an intermediary transfer member for carrying the toner image transferred from the image bearing member at a primary-transfer position; a transfer member, provided contactable with an outer peripheral surface of the intermediary transfer member, for transferring the toner image from the intermediary transfer member onto a recording material at a secondary-transfer position; a constant-voltage element, electrically connected between the intermediary transfer member and a ground potential, for maintaining a predetermined voltage by passing of a current therethrough; a power source for, by applying a voltage to the transfer member to pass the current through the constant-voltage element, both of forming a secondary-transfer electric field at the secondary-transfer position and a primary-transfer electric field at the primary-transfer position; a detecting portion for detecting the current passing through the transfer member; an executing portion for executing a test mode in which when no recording material exists at the secondary-transfer position, a test voltage is applied to the transfer member by the power source to detect the current by the detecting portion; and a controller for controlling, on the basis of the current detected by the detecting portion in the test mode, a voltage to be applied to the transfer member by the power source when the recording material exists at the secondary-transfer position, wherein the controller controls the test voltage applied by the power source so that the constant-voltage element maintains the predetermined voltage in at least an overlapping period between a period of the test mode and a period in which the toner image is transferred at the primary-transfer position.

Effect of the Invention

In the constitution in which the predetermined voltage is generated in the intermediary transfer member by the constant-voltage source, it is possible to avoid the transfer defect capable of generating in the case where the timing of the primary-transfer and the timing of application of the voltage to the transfer member are overlapped.

EMBODIMENTS FOR CARRYING OUT INVENTION

Figure 1:
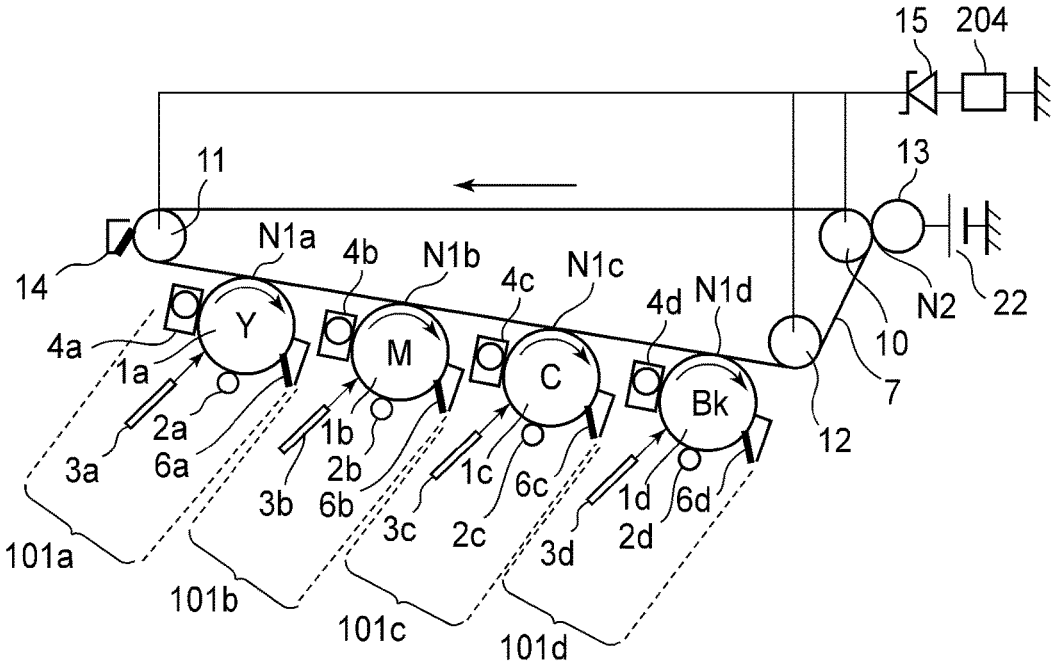
FIG. 1 is an illustration of a basic structure of an image forming apparatus.

In the following, embodiments of the present invention will be described along the drawings. Incidentally, in each of the drawings, the same reference numerals are assigned to elements having the same structures or functions, and the redundant description of these elements is omitted.

Embodiment 1

Image Forming Apparatus

FIG. 1 shows an image forming apparatus in this embodiment. The image forming apparatus employs a tandem type in which image forming units for respective colors are independent and arranged in tandem. In addition, the image forming apparatus employs an intermediary transfer type in which toner images are transferred from the image forming units for respective colors onto an intermediary transfer member, and then are transferred from the intermediary transfer member onto a recording material.

Image forming stations 101*a*, 101*b*, 101*c*, 101*d* are image forming means for forming yellow (Y), magenta (M), cyan (C) and black (K) toner images, respectively. These image forming units are disposed in the order of the image forming units 101*a*, 101*b*, 101*c* and 101*d*, that is, in the order of yellow, magenta, cyan and black, from an upstream side with respect to a movement direction of an intermediary transfer belt 7.

The image forming units 101*a*, 101*b*, 101*c*, 101*d* include photosensitive drums 1*a*, 1*b*, 1*c*, 1*d* as photosensitive members (image bearing members), respectively, on which the toner images are formed. Primary chargers 2*a*, 2*b*, 2*c*, 2*d* are charging means for charging surfaces of the respective photosensitive drums 1*a*, 1*b*, 1*c*, 1*d*. Exposure devices 3*a*, 3*b*, 3*c*, 3*sd* are provided with laser scanners to expose to light the photosensitive drums 1*a*, 1*b*, 1*c* and 1*d* charged by the primary chargers. By outputs of the laser scanners being rendered on and off on the basis of image information, electrostatic images corresponding to images are formed on the respective photosensitive drums. That is, the primary charger and the exposure means function as electrostatic image forming means for forming the electrostatic image on the photosensitive drum. Developing devices 4*a*, 4*b*, 4*c* and 4*d* are provided with accommodating containers for accommodating the yellow, magenta, cyan and black toner and are developing means for developing the electrostatic images on the photosensitive drum 1*a*, 1*b*, 1*c* and 1*d* using the toner.

The toner images formed on the photosensitive drums 1*a*, 1*b*, 1*c*, 1*d* are primary-transferred onto an intermediary transfer belt 7 in primary-transfer portions N1*a*, N1*b*, N1*c* and N1*d* (primary-transfer positions). In this manner, four color toner images are transferred superimposedly onto the intermediary transfer belt 7. The primary-transfer will be described in detail hereinafter.

Photosensitive member drum cleaning devices 6*a*, 6*b*, 6*c* and 6*d* remove residual toner remaining on the photosensitive drums 1*a*, 1*b*, 1*c* and 1*d* without transferring in the primary-transfer portions N1*a*, N1*b*, N1*c* and N1*d*.

The intermediary transfer belt 7 (intermediary transfer member) is a movable intermediary transfer member onto which the toner images are to be transferred from the photosensitive drums 1*a*, 1*b*, 1*c*, 1*d*. In this embodiment, the intermediary transfer belt 7 has a two layer structure including a base layer and a surface layer. The base layer is at an inner side (inner peripheral surface side, stretching member side) and contacts the stretching member. The surface layer is at an outer surface side (outer peripheral surface side, image bearing member side) and contacts the photosensitive drum. The base layer comprises a resin material such as polyimide, polyamide, PEN, PEEK, or various rubbers, with a proper amount of an antistatic agent such as carbon black incorporated. The base layer of the intermediary transfer belt 7 is formed to have a volume resistivity of $10^2$-$10^7$ Ωcm thereof. In this embodiment, the base layer comprises the polyimide, having a center thickness of approx. 45-150 μm, in the form of a film-like endless belt. Further, as a surface layer, an acrylic coating having a volume resistivity of $10^{13}$-$10^{16}$ Ωcm in a thickness direction is applied. That is, the volume resistivity of the base layer is lower than that of the surface layer.

In the case where the intermediary transfer member has two or more layer structure, the volume resistivity of the outer peripheral surface side layer is higher than that of the inner peripheral surface side layer.

The thickness of the surface layer is 0.5-10 μm. Of course, the thickness is not intended to be limited to these numerical values.

The intermediary transfer belt 7 is stretched while contacting the intermediary transfer belt 7 by stretching rollers 10, 11 and 12 contacting the inner peripheral surface of the intermediary transfer belt 7. The roller 10 is driven by a motor as a driving source, thus functioning as a driving roller for driving the intermediary transfer belt 7. Further, the roller 10 is also an inner secondary-transfer roller urged toward the outer secondary-transfer roller 13 with the intermediary transfer belt. The roller 11 functions as a tension roller for applying a predetermined tension to the intermediary transfer belt 7. In addition, the roller 11 functions also as a correction roller for preventing snaking motion of the intermediary transfer belt 7. A belt tension to the tension roller 11 is constituted so as to be approx. 5-12 kgf. By this belt tension applied, nips as primary-transfer portions N1*a*, N1*b*, N1*c* and N1*d* are formed between the intermediary transfer belt 7 and the respective photosensitive drums 1*a*-1*d*. The inner secondary-transfer roller 62 is drive by a motor excellent in constant speed property, and functions as a driving roller for circulating and driving the intermediary transfer belt 7.

The recording material is accommodated in a sheet tray for accommodating the recording material P. The recording material P is picked up by a pick-up roller at predetermined timing from the sheet tray and is fed to a registration roller. In synchronism with the feeding of the toner image on the intermediary transfer belt, the recording material P is fed by the registration roller to the secondary-transfer portion N2 for transferring the toner image from the intermediary transfer belt onto the recording material.

The outer secondary-transfer roller 13 (transfer member) is a secondary-transfer member for forming the secondary-transfer portion N2 (secondary-transfer position) together with the inner secondary-transfer roller 13 by urging the inner secondary-transfer roller 10 via the intermediary transfer belt 7 from the outer peripheral surface of the intermediary transfer belt 7. A secondary-transfer high-voltage (power) source 22 as a secondary-transfer voltage source is connected to the outer secondary-transfer roller 13, and is a voltage source (power source) capable of applying a voltage to the outer secondary-transfer roller 13.

When the recording material P is fed to the secondary-transfer portion N2, a secondary-transfer electric field is formed by applying, to the outer secondary-transfer roller 13, the secondary-transfer voltage of an opposite polarity to the toner, so that the toner image is transferred from the intermediary transfer belt 7 onto the recording material.

Incidentally, the inner secondary-transfer roller 10 is formed with EPDM rubber. The inner secondary-transfer roller is set at 20 mm in diameter, 0.5 mm in rubber thickness and 70° in hardness (Asker-C). The outer secondary-transfer roller 13 includes an elastic layer formed of NBR rubber, EPDM rubber or the like, and a core metal. The outer secondary-transfer roller 13 is formed to have a diameter of 24 mm.

With respect to a direction in which the intermediary transfer belt 7 moves, in a downstream side than the secondary-transfer portion N2, an intermediary transfer belt cleaning device 14 for removing a residual toner and paper powder which remain on the intermediary transfer belt 7 without being transferred onto the recording material at the secondary-transfer portion N2 is provided.

[Primary-Transfer Electric Field Formation in Primary-Transfer-High-Voltage-Less-System]

This embodiment employs a constitution in which the voltage source exclusively for the primary-transfer is omitted for cost reduction. Therefore, in this embodiment, in order to electrostatically primary-transfer the toner image from the photosensitive drum onto the intermediary transfer belt 7, the secondary-transfer voltage source 22 is used (hereinafter, this constitution is referred to as a primary-transfer-high-voltage-less-system).

However, in a constitution in which the roller for stretching the intermediary transfer belt is directly connected to the ground, even when the secondary-transfer voltage source 22 applies the voltage to the outer secondary-transfer roller 13, there is a liability that most of the current flows into the stretching roller side, and the current does not flow into the photosensitive drum side. That is, even when the secondary-transfer voltage source 22 applies the voltage, the current does not flow into the photosensitive drums 1*a*, 1*b*, 1*c* and 1*d* via the intermediary transfer belt 7, so that the primary-transfer electric field for transferring the toner image does not act between the photosensitive drums and the intermediary transfer belt.

Therefore, in order to cause a primary-transfer electric field action to act in the primary-transfer-high-voltage-less-system, it is desirable that passive elements are provided between each of the stretching rollers 10, 11 and 12 and the ground so as to pass the current toward the photosensitive drum side.

As a result, a potential of the intermediary transfer belt becomes high, so that the primary-transfer electric field acts between the photosensitive drum and the intermediary transfer belt.

Incidentally, in order to form the primary-transfer electric field in the primary-transfer-high-voltage-less-system, there is a need to pass the current along the circumferential direction of the intermediary transfer belt by applying the voltage from the secondary-transfer voltage source 22 (power source). However, if a resistance of the intermediary transfer belt itself is high, a voltage drop of the intermediary transfer belt with respect to a movement direction (circumferential direction) in which the intermediary transfer belt moves becomes large. As a result, there is also a liability that the current is less liable to pass through the intermediary transfer belt along the circumferential direction toward the photosensitive drums 1*a*, 1*b*, 1*c* and 1*d*. For that reason, the intermediary transfer belt may desirably have a low-resistant layer. In this embodiment, in order to suppress the voltage drop in the intermediary transfer belt, the base layer of the intermediary transfer belt is formed so as to have a surface resistivity of $10^2$ Ω/square or more and $10^8$ Ω/square or less. Further, in this embodiment, the intermediary transfer belt has the two-layer structure. This is because by disposing the high-resistant layer as the surface layer, the current flowing into a non-image portion is suppressed, and thus a transfer property is further enhanced easily. Of course, the layer structure is not intended to be limited to this structure. It is also possible to employ a single-layer structure or a structure of three layers or more.

Next, by using FIG. 2, a primary-transfer contrast which is a difference between the potential of the photosensitive drum and the potential of the intermediary transfer belt will be described.

Figure 2:
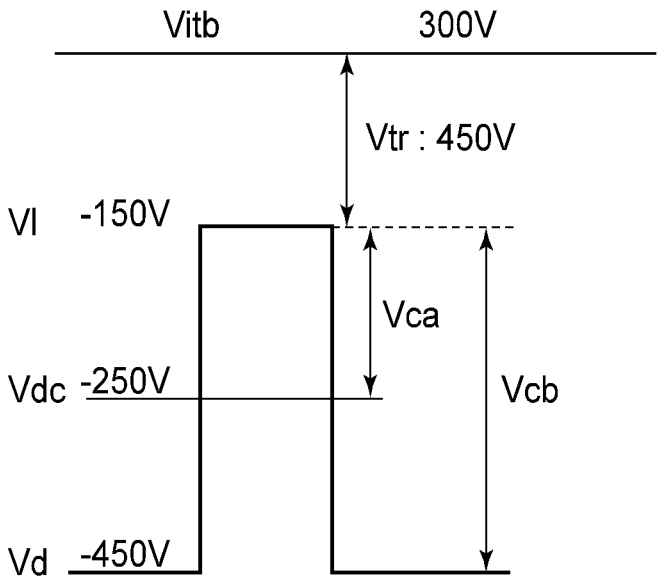
FIG. 2 is an illustration showing a relationship between a transferring potential and an electrostatic image potential.

FIG. 2 is the case where the surface of the photosensitive drum 1 is charged by the charging means 2, and the photosensitive drum surface has a potential Vd (−450 V in this embodiment). Further, FIG. 2 is the case where the surface of the charged photosensitive drum is exposed to light by the exposure means 3, and the photosensitive drum surface has V1 (−150 V in this embodiment). The potential Vd is the potential of the non-image portion where the toner is not deposited, and the potential V1 is the potential of an image portion where the toner is deposited. Vitb shows the potential of the intermediary transfer belt.

The surface potential of the drum is controlled on the basis of a detection result of a potential sensor provided in proximity to the photosensitive drum in a downstream side of the charging and exposure means and in upstream of the developing means.

The potential sensor detects the non-image portion potential and the image portion potential of the photosensitive drum surface, and controls a charging potential of the charging means on the basis of the non-image portion potential and controls an exposure light amount of the exposure means on the basis of the image portion potential.

By this control, with respect to the surface potential of the photosensitive drum, both potentials of the image portion potential and the non-image portion potential can be set at proper values.

With respect to this charging potential on the photosensitive drum, a developing bias Vdc (−250 V as a DC component in this embodiment) is applied by the developing device 4, so that a negatively charged toner is formed in the photosensitive drum side by development.

A developing contrast Vca which is a potential difference between the V1 of the photosensitive drum and the developing bias Vdc is: −150 (V)−(−250 (V))=100 (V).

An electrostatic image contrast Vcb which is a potential difference between the image portion potential V1 and the non-image portion potential Vd is: −150 (V)−(−450 (V)) =300 (V).

A primary-transfer contrast Vtr which is a potential difference between the image portion potential V1 and the potential Vitb (300 V in this embodiment) of the intermediary transfer belt is: 300 V−(−150 (V))=450 (V).

Incidentally, in this embodiment, a constitution in which the potential sensor is disposed by attaching importance to accuracy of detection of the photosensitive drum potential is employed, but the present invention is not intended to be limited to this constitution. It is also possible to employ a constitution in which a relationship between the electrostatic image forming condition and the potential of the photosensitive drum is stored in ROM in advance by attaching importance to the cost reduction without disposing the potential sensor, and then the potential of the photosensitive drum is controlled on the basis of the relationship stored in the ROM.

[Zener Diode]

In the primary-transfer-high-voltage-less-system, the primary-transfer is determined by the primary-transfer contrast (primary-transfer electric field) which is the potential difference between the potential of the intermediary transfer belt and the potential of the photosensitive drum. For that reason, in order to stably form the primary-transfer contrast, it is desirable that the potential of the intermediary transfer belt is kept constant.

Therefore, in this embodiment, Zener diode is used as a constant-voltage element disposed between the stretching roller and the ground. Incidentally, in place of the Zener diode, a varister may also be used.

Figure 3:
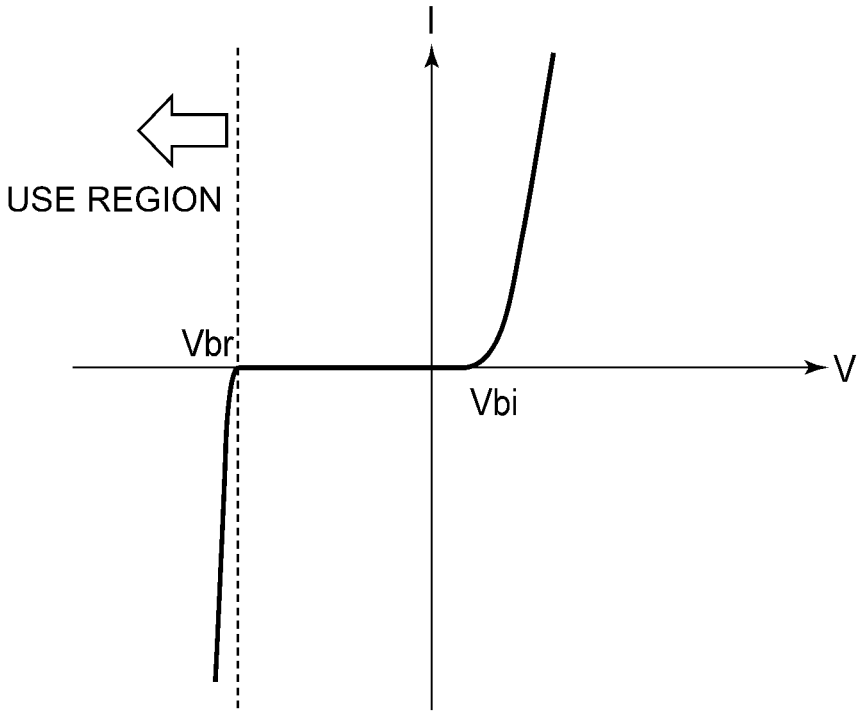
FIG. 3 is an illustration showing an IV characteristic of a Zener diode.

FIG. 3 shows a current-voltage characteristic of the Zener diode. The Zener diode causes the current to reduce flow until a voltage of Zener breakdown voltage Vbr or more is applied, but has a characteristic such that the current abruptly flows when the voltage of the Zener breakdown voltage or more is applied. That is, in a range in which the voltage applied to the Zener diode 15 is the Zener breakdown voltage (breakdown voltage) or more, the voltage drop of the Zener diode 15 is such that the current is caused to flow so as to maintain a Zener voltage.

By utilizing such a current-voltage characteristic of the Zener diode, the potential of the intermediary transfer belt 7 is kept constant.

That is, in this embodiment, the Zener diode 15 is disposed as the constant-voltage element between each of the stretching rollers 10, 11 and 12 and the ground.

In addition, during the primary-transfer, the secondary-transfer voltage source 22 applies the voltage so that the voltage applied to the Zener diode 15 is kept at the Zener breakdown voltage. As a result, during the primary-transfer, the belt potential of the intermediary transfer belt 7 can be kept constant.

In this embodiment, between each of the stretching rollers and the ground, 12 pieces of the Zener diode 15 providing a standard value Vbr, of 25 V, of the Zener breakdown voltage are disposed in a state in which they are connected in series. That is, in the range in which the voltage applied to the Zener diode is kept at the Zener breakdown voltage, the potential of the intermediary transfer belt is kept constant at the sum of Zener breakdown voltages of the respective Zener diodes, i.e., 25×12=300 V.

Of course, the present invention is not intended to be limited to the constitution in which the plurality of Zener diodes are used. It is also possible to employ a constitution using only one Zener diode.

Of course, the surface potential of the intermediary transfer belt is not intended to be limited to a constitution in which the surface potential is 300 V. The surface potential may desirably be appropriately set depending on the species of the toner and a characteristic of the photosensitive drum.

In this way, when the voltage is applied by the secondary-transfer voltage source 22, the potential of the Zener diode maintains a predetermined potential, so that the primary-transfer electric field is formed between the photosensitive drum and the intermediary transfer belt. Further, similarly as the conventional constitution, when the voltage is applied by the secondary-transfer high-voltage source, the secondary-transfer electric field is formed between the intermediary transfer belt and the outer secondary-transfer roller.

[Controller]

Figure 4:
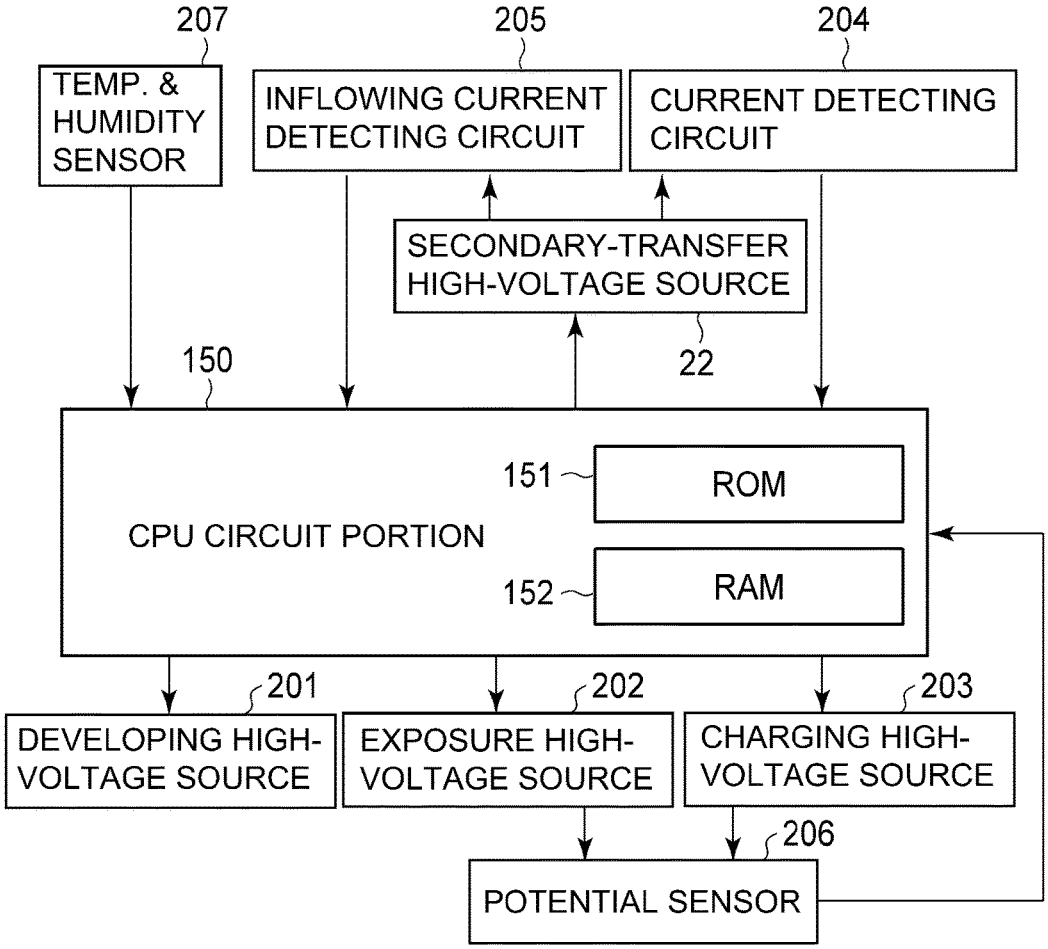
FIG. 4 is an illustration showing a block diagram of a control.

A constitution of a controller for effecting control of the entire image forming apparatus will be described with reference to FIG. 4. The controller includes a CPU circuit portion 150 (controller) as shown in FIG. 4. The CPU circuit portion 150 incorporates therein CPU, ROM 151 and RAM 152. A secondary-transfer portion current detecting circuit 204 is a circuit (detecting portion, first detecting portion) for detecting a current passing through the outer secondary-transfer roller. A stretching-roller-inflowing-current detecting circuit 205 (second detecting portion) is a circuit for detecting a current flowing into the stretching roller. A potential sensor 206 is a sensor for detecting the potential of the photosensitive drum surface. A temperature and humidity sensor 207 is a sensor for detecting a temperature and a humidity.

Into the CPU circuit portion 150, information from the secondary-transfer portion current detecting circuit 204, the stretching-roller-inflowing-current detecting circuit 205, the potential sensor 206 and the temperature and humidity sensor 207 is inputted. Then, the CPU circuit portion 150 effects integral control of the secondary-transfer voltage source 22, a developing high-voltage source 201, an exposure means high-voltage source 202 and a charging means high-voltage source 203 depending on control programs stored in the ROM 151. An environment table and a paper thickness correspondence table which are described later are stored in the ROM 151, and are called up and reflected by the CPU. The RAM 152 temporarily hold control data, and is used as an operation area of arithmetic processing with the control.

[Discriminating Function]

In this embodiment, in order to make the surface potential of the intermediary transfer belt not less than the Zener voltage, a step for discriminating a lower-limit voltage of the voltage applied by the secondary-transfer voltage source is executed. Description will be made using FIG. 5.

In this embodiment, in order to discriminate the lower-limit voltage, the stretching-roller-inflowing-current detecting circuit (second detecting portion) for detecting the current flowing into the ground via the Zener diode 15 is used. The stretching-roller-inflowing-current detecting circuit 205 is connected between the Zener diode and the ground. That is, each of the stretching rollers are connected to the ground potential via the Zener diode and the stretching-roller-inflowing-current detecting circuit.

As shown in FIG. 3, the Zener diode has a characteristic such that the current little flows in a range in which the voltage drop of the Zener diode is less than the Zener breakdown voltage. For that reason, when the stretching-roller-inflowing-current detecting circuit does not detect the current, it is possible to discriminate that the voltage drop of the Zener diode is less than the Zener breakdown voltage. Further, when the stretching-roller-inflowing-current detecting circuit detects the current, it is possible to discriminate that the voltage drop of the Zener diode maintains the Zener breakdown voltage.

First, charging voltages for all the stations for Y, M, C and Bk are applied, so that the surface potential of the photosensitive drum is controlled at the non-image portion potential Vd.

Figure 5:
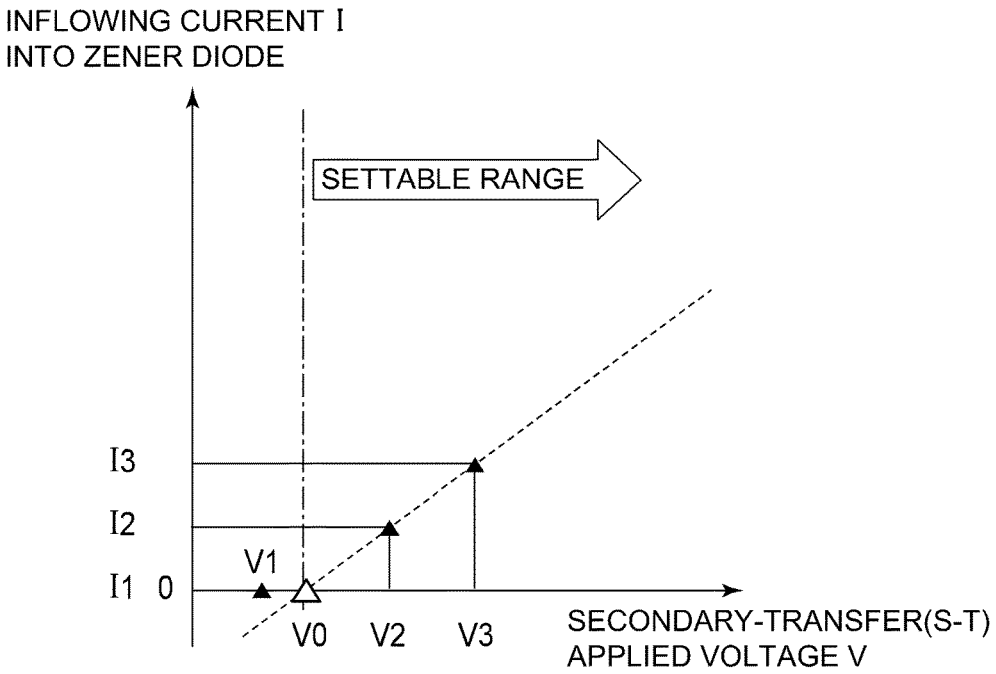
FIG. 5 is an illustration showing a relation between an inflowing current and an applied voltage.

Next, the secondary-transfer voltage source applies a test voltage. The test voltage applied by the secondary-transfer voltage source 22 is increased linearly or stepwisely. In FIG. 5, the test voltage is increased stepwisely in the order of V1, V2 and V3. When the voltage applied by the secondary-transfer voltage source is V1, the stretching-roller-inflowing-current detecting circuit does not detect the current (I1=0 μA). When the voltage applied by the secondary-transfer voltage source is V2 and V3, the stretching-roller-inflowing-current detecting circuit detects I2μA or I3μA, respectively. Here, from a correlation between an applied voltage and a detected current in the case where the stretching-roller-inflowing-current detecting circuit detects the current, a current inflowing starting voltage V0 corresponding to the case where the current starts to flow into the Zener diode is calculated. That is, from a relationship among I2, I3, V2 and V3, by performing linear interpolation, the current inflowing starting voltage V0 is carried.

As the voltage applied by the secondary-transfer voltage source, by setting a voltage exceeding V0, the voltage drop of the Zener diode can be made so as to maintain the Zener breakdown voltage.

Figure 6:
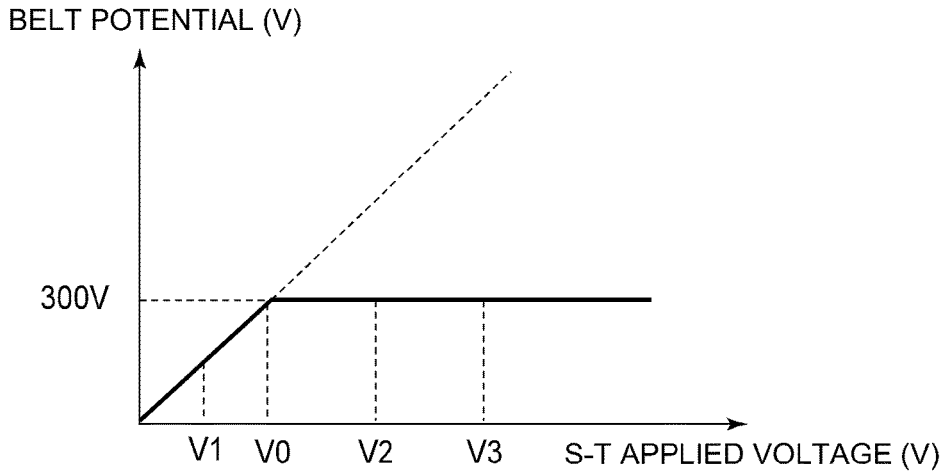
FIG. 6 is an illustration showing a relation between a belt potential and an applied voltage.

A relationship, at this time, between the voltage applied by the secondary-transfer voltage source and the belt potential of the intermediary transfer belt is shown in FIG. 6.

For example, in this embodiment, the Zener voltage of the Zener diode is set at 300 V. For that reason, in a range in which the potential of the intermediary transfer belt is less than 300 V, the current does not flow into the Zener diode, and when the belt potential of the intermediary transfer belt is 300 V, the current starts to flow into the Zener diode. Even when the voltage applied by the secondary-transfer voltage source is increased further, the belt potential of the intermediary transfer belt is controlled so as to be constant.

That is, in a range of less than V0 at which the flow of the current into the Zener diode is started to be detected, when the secondary-transfer bias is changed, the belt potential cannot be controlled at the constant voltage. In a range exceeding V0 at which the flow of the current into the Zener diode is started to be detected, even when the secondary-transfer bias is changed, the belt potential can be controlled at the constant voltage.

Incidentally, in this embodiment, before and after the current inflowing starting voltage are used as the test voltage, but the present invention is not intended to be limited to this constitution. As the test voltage, by setting a larger predetermined voltage in advance, it is also possible to employ a constitution in which all the test voltages exceeds the current inflowing starting voltage. In such a constitution, there is an advantage such that a discriminating step can be omitted.

Incidentally, in this embodiment, by attaching importance to enhancement of accuracy of calculation of the current inflowing starting voltage, a constitution in which a discriminating function for calculating the current inflowing starting voltage V0 is executed is employed. Of course, the present invention is not intended to be limited to this constitution. By attaching important to suppression of long downtime, not the constitution in which the discriminating function for calculating the current inflowing starting voltage V0 is executed, it is also possible to employ a constitution in which the current inflowing starting voltage V0 is stored in the ROM in advance.

[Test Mode for Setting Secondary-Transfer Voltage]

In this embodiment, in order to set the secondary-transfer voltage at which the toner image is to be transferred onto the recording material, a test mode which is called ATVC (Active Transfer Voltage Control) in which an adjusting voltage (test voltage) is applied is executed. This is a test mode for setting the secondary-transfer voltage and is executed during non-sheet-passing in which the recording material does not pass through the secondary-transfer portion. There is also a case where this test mode is executed when a region corresponding to a region between recording materials is in the secondary-transfer position in the case where the images are continuously formed. By the ATVC, it is possible to grasp a correlation between the voltage applied by the secondary-transfer voltage source and the current passing through the secondary-transfer portion.

In order to suppress the long downtime, it is desirable that the ATVC and the primary-transfer are carried out in parallel. However, when the ATVC and the primary-transfer are carried out in parallel, if the voltage drop of the Zener diode is less than the Zener breakdown voltage, there is a liability that the primary-transfer is made unstable.

Therefore, in this embodiment, when the ATVC and the primary-transfer are carried out in parallel when no recording material exists at the secondary-transfer portion, the adjusting voltage is set so that the voltage drop of the Zener diode is kept at the Zener breakdown voltage.

Incidentally, the ATVC is carried out by controlling the secondary-transfer voltage source by the CPU circuit portion 150 when no recording material exists at the secondary-transfer portion. That is, the CPU circuit portion 150 functions as an executing portion for executing the ATVC for setting the secondary-transfer voltage.

In the ATVC, a plurality of adjusting voltages Va, Vb and Vd which are constant-voltage-controlled are applied by the secondary-transfer voltage source. Then, in the ATVC, currents Ia, Ib and Ic flowing when the adjusting voltages are applied are detected, respectively, by the secondary-transfer portion current detecting circuit 204 (detecting portion, first detecting portion). This is because the correlation between the voltage and the current is grasped.

Set values of the adjusting voltages in this embodiment will be described.

In this embodiment, the current inflowing starting voltage V0 is calculated by the discriminating function. ΔV1 and ΔV2 are stored in advance in the ROM of the CPU circuit portion. The adjusting voltage Va is calculated by adding ΔV1 to the current inflowing starting voltage V0, the adjusting voltage Vb is calculated by adding ΔV2 to the adjusting voltage Va, and the adjusting voltage Vc is calculated by adding ΔV2 to the adjusting voltage Vb. When the above is summarized, the respective adjusting voltages Va, Vb and Vc are represented by the following formulas.

$$Va=V0+\Delta V1$$

$$Vb=Va+\Delta V2$$

$$Vc=Vb+\Delta V2$$

That is all the adjusting voltages Va, Vb and Vc including a lowest voltage Va of the adjusting voltages are set so as to exceed the current inflowing starting voltage V0. For that reason, during the execution of the ATVC, the voltage drop of the Zener diode is kept at the Zener breakdown voltage.

For that reason, in the case where the ATVC and the primary-transfer are carried out in parallel when no recording material exists at the secondary-transfer portion, it is suppressed that the voltage drop of the Zener diode is less than the Zener breakdown voltage.

Further, in this embodiment, ΔV1 is set so that the voltage Va which is smallest among the adjusting voltages is a lower value than the secondary-transfer voltage for forming the secondary-transfer electric field. Further, ΔV2 is set so that the voltage Vc which is largest among the adjusting voltages is higher value than the secondary-transfer voltage.

Incidentally, in the above ATVC, an example in which the currents flowing when the plurality of adjusting voltages which are constant-voltage-controlled are applied by the secondary-transfer voltage source are detected by the detecting portion is shown, but this can be executed by constant-current control. That is, the applied voltage when the current is passed at a predetermined constant-current value may also be detected by a voltage detecting portion. Incidentally, in this embodiment, when the ATVC is executed, a constitution in which the voltage drop of the Zener diode is always kept at the Zener breakdown voltage is employed. However, the present invention is not intended to be limited to this constitution. In a period in which the primary-transfer is not carried out when the ATVC is executed, it is also possible to employ a constitution in which the voltage drop of the Zener diode is not kept at the Zener breakdown voltage but is less than the Zener breakdown voltage.

[Secondary-Transfer Target Current Setting]

On the basis of a correlation between the plurality of applied adjusting voltages, Va, Vb and Vc and the measured currents Ia, Ib and Ic, a voltage Vi for causing a secondary-transfer target current It required for the secondary-transfer to flow is calculated. The secondary-transfer target current It is set on the basis of a matrix shown in Table 1.

TABLE 1

| | WC*1 (g/kg) | | | | | | |
|---|---|---|---|---|---|---|---|
| | 0.8 | 2 | 6 | 9 | 15 | 18 | 22 |
| STTC*2 (μA) | 32 | 31 | 30 | 30 | 29 | 28 | 25 |

*1"WC" represents water content.
*2"STTC" represents the secondary-transfer target current.

Table 1 is a table stored in a storing portion provided in the CPU circuit portion 150. This table sets and divides the secondary-transfer target current It depending on absolute water content (g/kg) in an atmosphere. This reason will be described. When the water content becomes high, a toner charge amount becomes small. Therefore, when the water content becomes high, the secondary-transfer target current It is set so as to become small. That is, when the water content is increased, the secondary-transfer target current is decreased. Incidentally, the absolute water content is calculated by the CPU circuit portion 150 from the temperature and relative humidity which are detected by the temperature and humidity sensor 207. Incidentally, in this embodiment, the absolute water content is used, but the water content is not intended to be limited to this. In place of the absolute water content, it is also possible to use the humidity.

Here, the voltage V1 for passing It is a voltage for passing It in the case where no recording material exists at the secondary-transfer portion. However, the secondary-transfer is carried out when the recording material exists at the secondary-transfer portion. Therefore, it is desirable that a resistance for the recording material is taken into account. Therefore, a recording material sharing voltage Vii is added to the voltage Vi. The recording material sharing voltage Vii is set on the basis of a matrix shown in Table 2.

TABLE 2

| PLAIN PAPER | | WC*1 | | | | | | |
|---|---|---|---|---|---|---|---|---|
| | | 0.8 | 2 | 6 | 9 | 15 | 18 | 22 |
| 64-79 (gsm) | | | | | | | | |
| (UNIT: V) | OS*2 | 900 | 900 | 850 | 800 | 750 | 500 | 400 |
| | ADS*3 | 1000 | 1000 | 950 | 900 | 850 | 750 | 500 |
| | MDS*4 | 1000 | 1000 | 950 | 900 | 850 | 750 | 500 |
| 80-105 (gsm) | | | | | | | | |
| (UNIT: V) | OS*2 | 950 | 950 | 900 | 850 | 800 | 550 | 450 |
| | ADS*3 | 1050 | 1050 | 1000 | 950 | 900 | 800 | 550 |
| | MDS*4 | 1050 | 1050 | 1000 | 950 | 900 | 800 | 550 |
| 106-128 (gsm) | | | | | | | | |
| (UNIT: V) | OS*2 | 1000 | 1000 | 950 | 900 | 850 | 600 | 500 |
| | ADS*3 | 1100 | 1100 | 1050 | 1000 | 950 | 850 | 600 |
| | MDS*4 | 1100 | 1100 | 1050 | 1000 | 950 | 850 | 600 |
| 129-150 (gsm) | | | | | | | | |
| (UNIT: V) | OS*2 | 1050 | 1050 | 1000 | 950 | 900 | 650 | 550 |
| | ADS*3 | 1150 | 1150 | 1100 | 1050 | 1000 | 900 | 650 |
| | MDS*4 | 1150 | 1150 | 1100 | 1050 | 1000 | 900 | 650 |

*1"WC" represent the water content.
*2"OS" represents one side (printing).
*3"ADS" represents automatic double side (printing).
*4"MDS" represents manual double side (printing).

Table 2 is a table stored in the storing portion provided in the CPU circuit portion 150. This table sets and divides the recording material sharing voltage Vii depending on the absolute water content (g/kg) in an atmosphere and a recording material basis weight (g/m$^2$). When the basis weight is increased, the recording material sharing voltage Vii is increased. This is because when the basis weight is increased, the recording material becomes thick and therefore an electric resistance of the recording material is increased. Further, when the absolute water content is increased, the recording material sharing voltage Vii is decreased. This is because when the absolute water content is increased, the content of water contained in the recording material is increased, and therefore the electric resistance of the recording material is increased. Further, the recording material sharing voltage Vii is larger during automatic double-side printing and during manual double-side printing than during one-side printing. Incidentally, the basis weight is a unit showing a weight per unit area (g/m$^2$), and is used in general as a value showing a thickness of the recording material. With respect to the basis weight, there are the case where a user inputs the basis weight at an operating portion and the case where the basis weight of the recording material is inputted into the accommodating portion for accommodating the recording material. On the basis of these pieces of information, the CPU circuit portion 150 discriminate the basis weight.

A voltage (Vi+Vii) obtained by adding the recording material sharing voltage Vii to Vi for passing the secondary-transfer target current It is set, by the CPU circuit portion 150, as a secondary-transfer target voltage Vt, for secondary-transfer, which is constant-voltage-controlled. That is, the CPU circuit portion 150 functions as a controller for controlling the secondary-transfer voltage. As a result, a proper voltage value is set depending on an adjusting voltage environment and paper thickness. Further, during the secondary-transfer, the secondary-transfer voltage is applied in a constant-voltage-controlled state by the CPU circuit portion 150, and therefore even when a width of the recording material is changed, the secondary-transfer is carried out in a stable state.

[Timing of Control]

Figure 7:
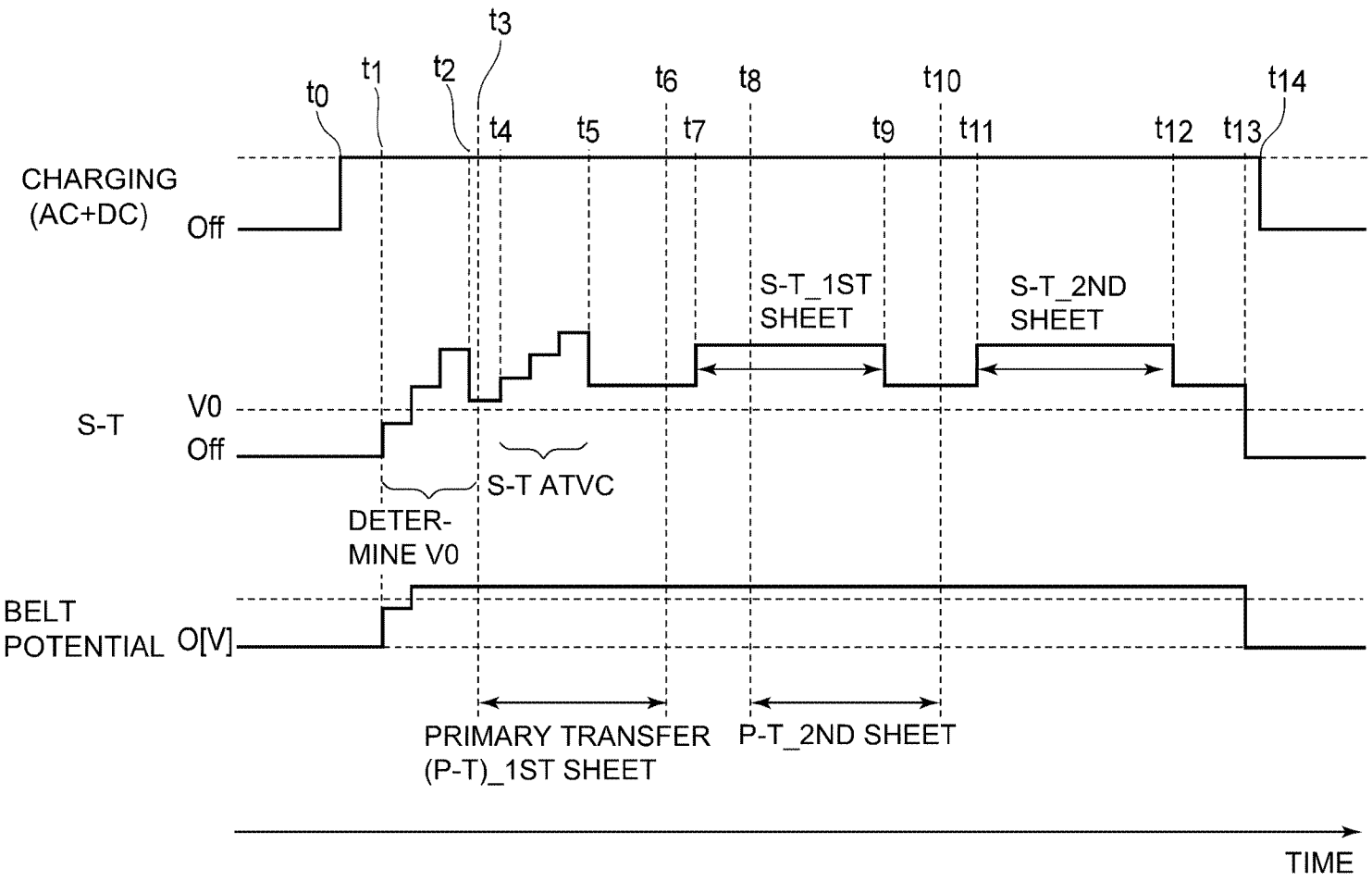
FIG. 7 is a time chart of a control of a secondary-transfer voltage source.

FIG. 7 shows a timing chart of a charging voltage (V, M, C, Bk), applied voltage of the secondary-transfer voltage source, primary-transfer and secondary-transfer. Incidentally, FIG. 7 is the case where the images are continuously formed on the recording materials.

When an image forming signal is inputted, the charging voltage is turned on (t0). Thereafter, the discriminating function for discriminating the current inflowing starting voltage V0 is executed in a period from t1 to t2. Thereafter, the ATVC is carried out in a period front t4 to t5. Thereafter, in a period from t7 to t9, the secondary-transfer is executed. The secondary-transfer is carried out by applying, when there is a first sheet of the recording material at the secondary-transfer portion, the secondary-transfer voltage set on the basis of the ATVC. Thereafter, in a period from t11 to t12, the secondary-transfer for a second sheet of the recording material passing through the secondary-transfer portion is executed. Thereafter, the voltage applied to the outer secondary-transfer roller is turned off (t13), and the charging is turned off (t14).

Further, in this embodiment, a voltage lowering function for lowering the voltage is executed in a period from discriminating function end timing (t2) to ATVC start timing (t4). Further, the voltage lowering function for lowering the voltage is executed in a period from ATVC end timing (t5) to secondary-transfer start timing (t7) for the first sheet of the recording material. Further, the voltage lowering function for lowering the voltage is executed in a period from secondary-transfer end timing (t9) to secondary-transfer start timing (t11) for the second sheet of the recording material. The voltage lowering function is a function of applying a voltage lower than the transfer voltage for forming the secondary-transfer electric field. This reason will be described. For the secondary-transfer roller, an ion conductive material is used, and therefore there is a tendency that the electric resistance by energization is increased. That is because when the voltage applied to the outer secondary-transfer roller is large, the resistance of the outer secondary-transfer roller is increased early, and there is a liability that a lifetime ends early. Incidentally, in this embodiment, the primary-transfer for the first sheet of the recording material starts at timing (t3) after t2 and before t4, and ends at timing (t6) after t5 and before t7.

For that reason, in the period from t4 and t5, in a state in which no recording material exists at the secondary-transfer portion, the primary-transfer for the first sheet of the recording material and the ATVC are executed in parallel. When the adjusting voltage is applied, if the voltage drop of the Zener diode is less than the Zener breakdown voltage, there is a liability that the primary-transfer defect is caused. Therefore, in this embodiment, in order to compatibly realize the primary-transfer and the ATVC, all the adjusting voltages Va, Vb and Vc in the ATVC are set so that the voltage drop of the Zener diode maintains the Zener breakdown voltage. That is, $Va=V0+\Delta V1>V0$, $Vb=Va+\Delta V2>V0$ and $Vc=Vb+\Delta V2>V0$. As a result, even when the primary-transfer and the ATVC are executed in parallel, it is suppressed that the voltage drop of the Zener diode is less than the Zener breakdown voltage, and therefore it is possible to suppress generation of the primary-transfer defect.

Further, in the period from t5 to 6, in a state in which no recording material exists at the secondary-transfer portion, the primary-transfer for the first sheet of the recording material and the voltage lowering function is executed in parallel. When the voltage lowering function is executed, if the voltage drop of the Zener diode is less than the Zener breakdown voltage, there is a liability that the primary-transfer defect is caused. Therefore, in this embodiment, in order to compatibly realize the primary-transfer and the voltage application control, in the period from the t5 to t7, an applied voltage V4 in the voltage lowering function is set so that the voltage drop of the Zener diode maintains the Zener breakdown voltage. As V4, a value obtained by adding ΔV0 to the current inflowing starting voltage V0 is set ($V4=V0+\Delta V0>V0$). Incidentally, V0 is calculated by the discriminating function, and ΔV0 is stored in the RAM in advance. As a result, even when the primary-transfer and the voltage lowering function are executed in parallel, it is suppressed that the voltage drop of the Zener diode is less than the Zener breakdown voltage, and therefore it is possible to suppress generation of the primary-transfer defect.

In this embodiment, the primary-transfer of the second sheet starts at timing (t8) after t7 and before t9 and ends at timing (t10) after t9 and before t11.

For that reason, in a period from t8 to t9, the primary-transfer for the second sheet of the recording material and the secondary-transfer for the first sheet of the recording material are executed in parallel. The secondary-transfer voltage is set so that the voltage drop of the Zener diode maintains the Zener breakdown voltage. For that reason, even when the primary-transfer and the secondary-transfer are executed in parallel, it is possible to suppress generation of the primary-transfer defect resulting from a phenomenon that the voltage drop of the Zener diode is less than the Zener breakdown voltage.

In a period from t9 and t10, in a region between the first sheet of the recording material and the second sheet of the recording material, the primary-transfer and the voltage lowering function are executed in parallel. When the voltage lowering function is executed, if the voltage drop of the Zener diode is less than the Zener breakdown voltage, there is a liability that the primary-transfer defect is caused. Therefore, in this embodiment, in order to compatibly realize the primary-transfer and the voltage application control, in the period from the t9 to t11, the applied voltage V4 ($Vd=V0+\Delta V0>V0$) in the voltage lowering function is set so that the voltage drop of the Zener diode maintains the Zener breakdown voltage. As a result, even when the primary-transfer and the voltage lowering function are executed in parallel in the region between the recording materials, it is possible to suppress generation of the primary-transfer defect due to a phenomenon that the voltage drop of the Zener diode is less than the Zener breakdown voltage.

Incidentally, in this embodiment, in a period from timing when the primary-transfer onto the first recording material to the end of the secondary-transfer onto the final recording material, the voltage is set so as to always maintain the Zener breakdown voltage. However, the present invention is not intended to be limited to this constitution. It is possible to employ a constitution in which the voltage is set so as to maintain the Zener breakdown voltage at least in a period in which the primary-transfer and the control of the voltage source of the secondary-transfer when no recording material exists at the secondary-transfer portion and executed in parallel. For example, in this embodiment, even in the period from t6 to t7, a constitution in which the voltage applied to the outer secondary-transfer roller by the secondary-transfer voltage source 22 is set so that the voltage drop of the Zener diode maintains the Zener breakdown voltage is employed.

However, in the period from t6 to t7, the primary-transfer is not carried out. Therefore, by attaching importance to suppression of the deterioration of the secondary-transfer roller, in the period from t6 to t7, it is also possible to employ a constitution in which the voltage is turned off. Also with respect to the period from t10 to t11, the above constitutions are similarly employed. That is, in this embodiment, also in the period from t10 to t11, the constitution in which the voltage applied to the outer secondary-transfer roller by the secondary-transfer voltage source 22 is set so that the voltage drop of the Zener diode maintains the Zener breakdown voltage is employed. However, in the period from t10 to t11, the primary-transfer is not carried out. Therefore, by attaching importance to suppression of the deterioration of the secondary-transfer roller, in the period from t10 to t11, it is also possible to employ the constitution in which the voltage is turned off.

That is, in this embodiment, even when the ATVC or the voltage lowering function is executed in parallel with the primary-transfer when no recording material exists at the secondary-transfer portion, the voltage drop of the Zener diode is made so as not to be less than the Zener breakdown voltage. For this reason, it is possible to suppress that the primary-transfer becomes unstable while suppressing that the downtime becomes long.

Embodiment 2

In Embodiment 1, in the period from t4 to t5, in the state in which no recording material exists at the secondary-transfer portion, the primary-transfer for the first sheet of the recording material and the ATVC are executed in parallel.

However, in Embodiment 2, the ATVC starts before t3 when the primary-transfer for the first sheet of the recording material starts.

Figure 8:
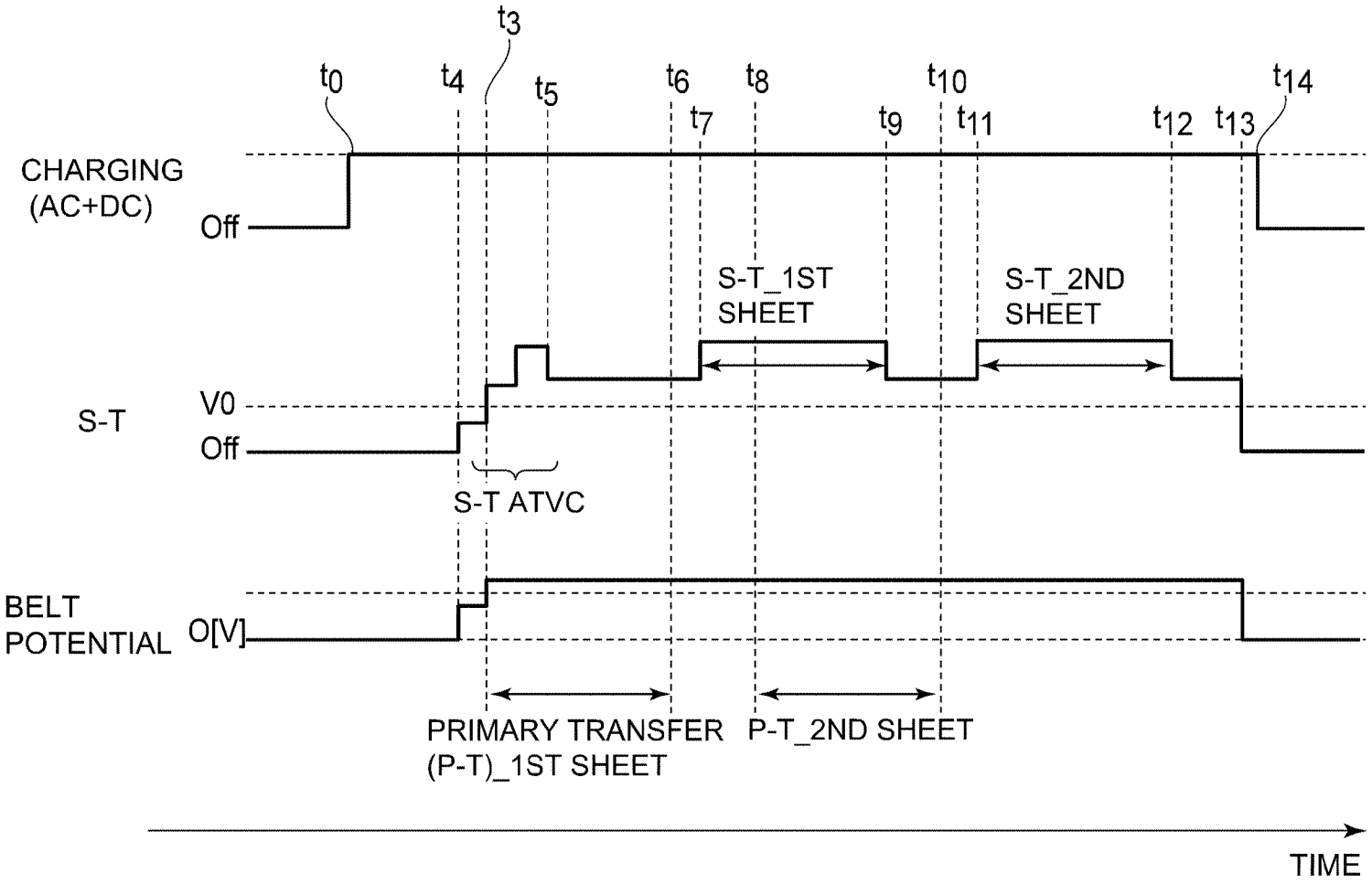
FIG. 8 is a time chart of a control of the secondary-transfer voltage source in another embodiment.

FIG. 8 shows a timing chart of the charging voltage (Y, M, C, Bk), the applied voltage of the secondary-transfer voltage source, the primary-transfer and the secondary-transfer.

In this embodiment, the discrimination of the current inflowing starting voltage V0 is omitted, and the ATVC for setting the secondary-transfer voltage is executed in a period from t4 to t5.

In this embodiment, the primary-transfer for the first sheet of the recording material starts at timing (t3) after t4 and t5.

In adjustment in the ATVC, accuracy of the adjustment is improved by changing the voltage in a wide range to the possible extent. Therefore, in this embodiment, the adjusting voltage Va is set at a voltage not more than the Zener breakdown voltage.

However, in this embodiment, the application of the adjusting voltage Va starts before the primary-transfer starts, and ends simultaneously with the start of the primary-transfer, and therefore the influence of the application of the voltage not more than the Zener breakdown voltage is not exerted on the primary-transfer, so that the transfer defect is not generated.

Further, simultaneously with t3 when the application of the adjusting voltage Va ends, the primary-transfer starts, and Vb and Vc for maintaining the Zener breakdown voltage are applied successively.

In a period in which the primary-transfer and the application of Vb and Vc are executed in parallel, the voltage drop of the Zener diode is not less than the Zener breakdown voltage, and therefore it is possible to suppress generation of the primary-transfer defect.

Incidentally, at timing after the turning-on of the power at start of the day or the like timing, there is a case where preparation for image formation is not complete, and in the case where the ATVC is not started during the ATVC, of course the adjusting voltage is settable at the voltage not more than the Zener breakdown voltage.

Embodiment 3

In Embodiment 3, the ATVC is executed by detecting the voltage, by a detecting circuit for detecting the voltage, of the secondary-transfer voltage source 22 when a test current is passed by subjecting the secondary-transfer voltage source 22 to constant-current control.

In a period from t4 to t5, in the state in which no recording material exists at the secondary-transfer portion, the primary-transfer for the first sheet of the recording material and the passing of the test current which is constant-current-controlled are executed in parallel.

Figure 9:
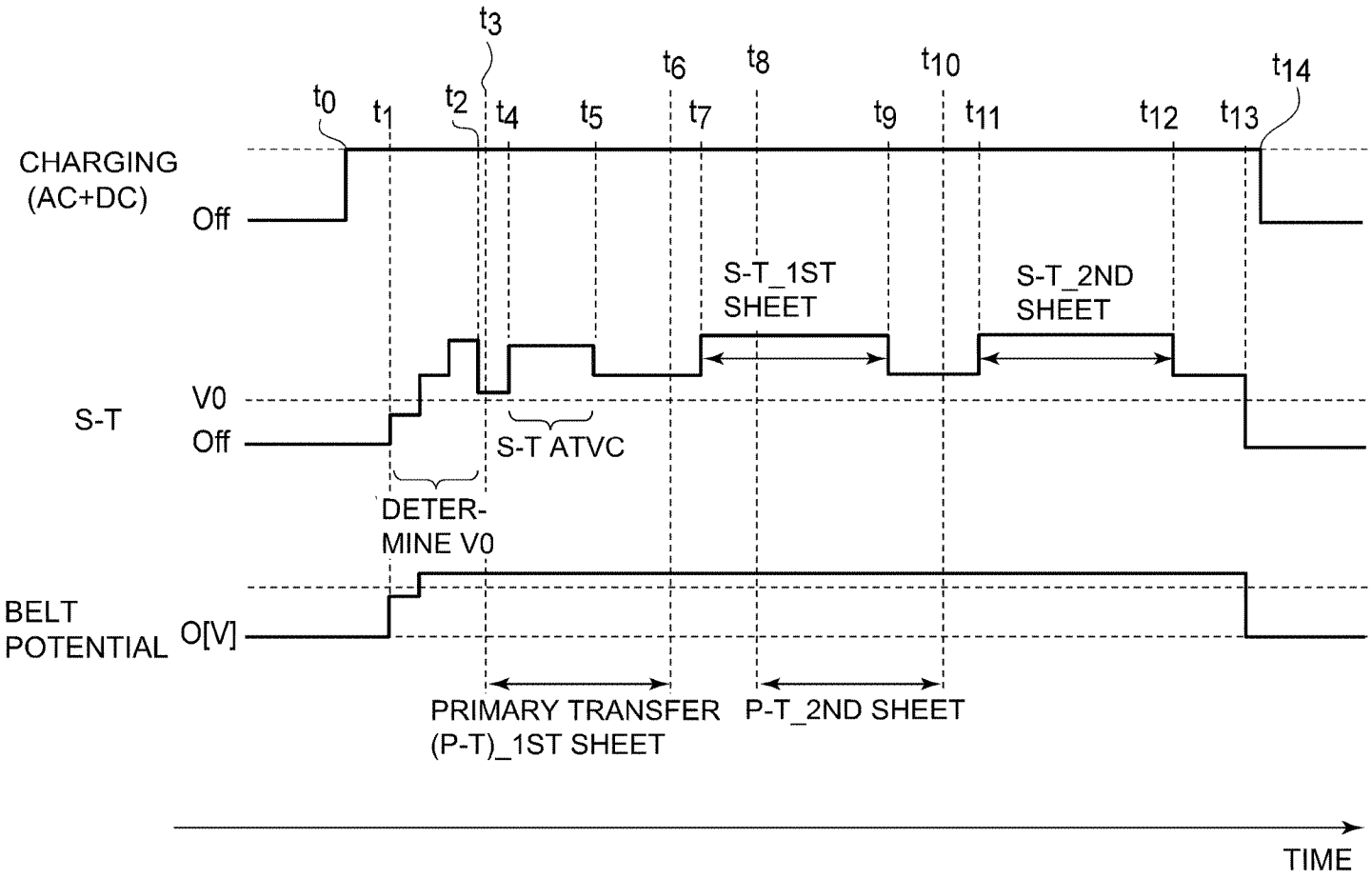
FIG. 9 is a time chart of a control of the secondary-transfer voltage source in another embodiment.

FIG. 9 shows a timing chart of the charging voltage (Y, M, C, Bk), the applied voltage of the secondary-transfer voltage source, the primary-transfer and the secondary-transfer.

In this embodiment, the test current of the secondary-transfer voltage source 22 is set as a target current value, and the ATVC is executed in a period from t4 to t5.

In this embodiment, the voltage of the secondary-transfer voltage source 22 when the test current is passed is set at the voltage where the Zener breakdown voltage can be maintained.

Further, a voltage obtained by adding the recording material sharing voltage to the voltage detected during the ATVC is applied to the outer secondary-transfer roller during the secondary-transfer from t7 to t9.

In this embodiment, the voltage when the test current is passed is set at the voltage where the Zener breakdown voltage can be maintained, and therefore the potential of the intermediary transfer belt during the primary-transfer is not lowered to a value less than the Zener breakdown voltage, so that the transfer defect is not generated.

Embodiment 4

Temperature Characteristic of Zener Diode

In this embodiment, in order to stabilize the primary-transfer, the Zener diode is connected between the intermediary transfer belt and the ground, and in addition, during the primary-transfer, the voltage is applied so that the voltage drop of the Zener diode maintains the Zener breakdown voltage.

However, the Zener diode itself has a temperature characteristic such that the Zener breakdown voltage changes depending the temperature.

That is, a standard voltage of the Zener breakdown voltage is a value with respect to a predetermined reference temperature, and therefore at the predetermined reference temperature, the Zener breakdown voltage is the standard voltage. That is, at the predetermined reference temperature, the voltage drop of the Zener diode maintains the standard voltage. However, in the case where the temperature is different from the reference temperature, an actual Zener breakdown voltage is a value different from the standard voltage. That is, the voltage drop of the Zener breakdown voltage maintains the voltage different from the standard voltage. Then, the potential of the intermediary transfer member is a value different from a voltage determined by the standard voltage.

In the case where the temperature is high, an absolute value of the Zener breakdown voltage is large. In this case, there is a liability that the applied voltage is less than the voltage necessary to maintain the Zener breakdown voltage. As a result, there is a liability that the primary-transfer is unstable.

Therefore, in this embodiment, correspondingly to the temperature characteristic of the Zener diode, the voltage to be applied to the outer secondary-transfer roller is controlled. In a constitution in which the voltage source exclusively for the primary-transfer is omitted for the cost reduction and in which the intermediary transfer member is connected to the Zener diode for stabilizing the primary-transfer, it is suppressed that the voltage applied to the Zener diode is less than the Zener breakdown voltage due to the temperature characteristic of the Zener diode.

Figure 10:
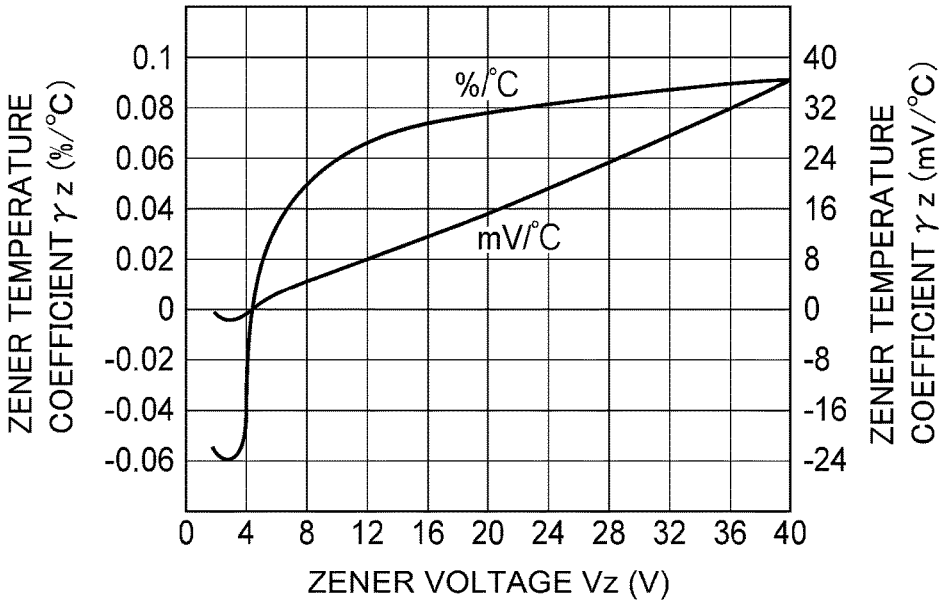
FIG. 10 shows a temperature characteristic of the Zener diode.
Figure 10:
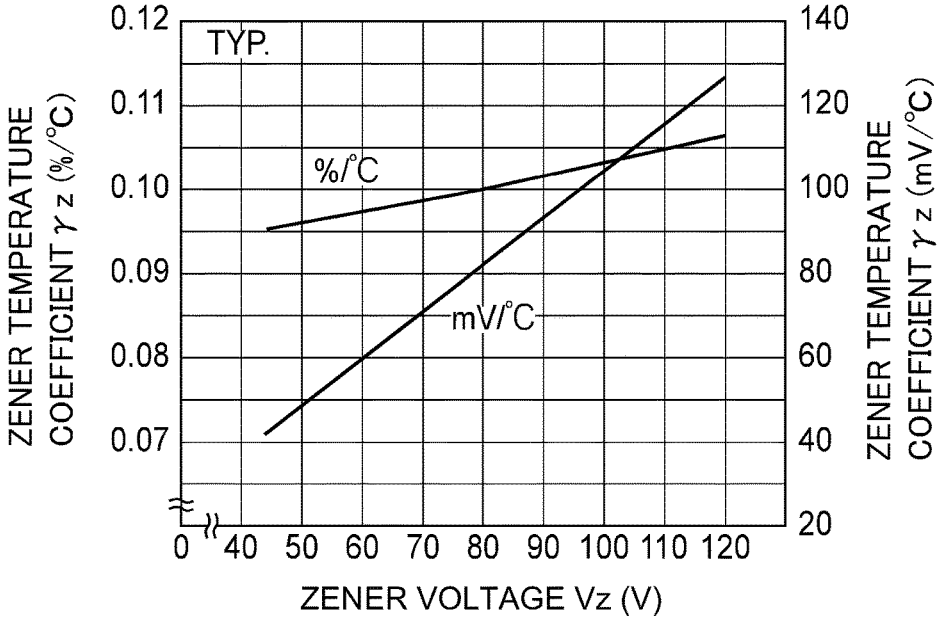

Incidentally, with a higher temperature inside the apparatus, an absolute value of the Zener breakdown voltage becomes larger, and therefore in order to maintain the Zener breakdown voltage, the voltage to be applied to the outer secondary-transfer roller is made large. The Zener diode has a temperature characteristic such that a Zener breakdown voltage Vbr is changed with an ambient temperature even when an inflowing current is kept constant. FIG. 10 shows a relationship between the Zener breakdown voltage Vbr and a temperature coefficient γz. The Zener diode has a characteristic such that a value of the temperature coefficient γz becomes large with an increasing Zener breakdown voltage Vbr per one Zener diode.

[Fluctuation Amount of Potential Vitb of Intermediary Transfer Belt]

Here, a constitution in this embodiment in which the potential Vitb of the intermediary transfer belt is maintained at 300 V by connecting two pieces of the Zener diode, in series, of 150 V in Zener breakdown voltage Vbr will be described. Also a constitution in which the potential Vitb of the intermediary transfer belt is maintained at 450 V by connecting three pieces of the Zener diode in series, and a constitution in which the potential Vitb of the intermediary transfer belt is maintained at 600 V by connecting four pieces of the Zener diode in series will be described.

First, in this embodiment, the temperature and humidity sensor 207 (temperature detecting member) is disposed in the neighborhood of the Zener diode inside the image forming apparatus, so that it is possible to detect the ambient temperature in the neighborhood of the Zener diode in real time.

The ambient temperature inside the image forming apparatus reaches a highest state immediately after sheets are continuously passed in automatic double-side (printing) in a high-temperature and high-humidity environment (30° C., 80% RH), and increases up to about 50° C. On the other hand, immediately after the image forming apparatus is actuated in a low-temperature and low-humidity environment (15° C., 10% RH), the ambient temperature is approximately 15° C. That is, when these are compared, the ambient temperature in the image forming apparatus has a fluctuation range of about 35° C.

TABLE 3

| | WC*1 (g/m³) | | | | | | | | | | | | | |
|---|---|---|---|---|---|---|---|---|---|---|---|---|---|---|
| | 22 | | 18 | | 15 | | 9 | | 6 | | 2 | | 0.8 | |
| AT*2 (° C.) | 26 | 50 | 23 | 50 | 20 | 45 | 11 | 46 | 10 | 40 | 15 | 35 | 15 | 35 |
| STTC*3 (μA) | 32 | | 31 | | 30 | | 30 | | 29 | | 28 | | 25 | |

*1"WC" represents the water content.
*2"AT" represents the ambient temperature.
*3"STTC" represents the secondary-transfer target current.

Table 3 shows the fluctuation range of the ambient temperature with respect to each absolute water content (g/m³) in the environment. For example, even in one ambient environment in which the absolute water content of 9 (g/m³), the ambient temperature has the fluctuation range, of about 35° C., from 11° C. to 46° C. Here, from FIG. 10, the Zener breakdown voltage Vbr and the temperature coefficient γz provides a relation:

$$\gamma z = 1.1 \times Vbr - 5.0,$$

and therefore the temperature coefficient γz at Vbr=150 V is 160 mV/° C. As a result, a fluctuation amount ΔVitb of the potential Vitb of the intermediary transfer belt 56 is, by the fluctuation of the ambient temperature, in the case of Vitb=300 V, $$160(\text{mV/° C.}) \times 35(\text{° C.}) \times 2(\text{pieces}) = 11.2(V),$$

in the case of Vitb=450 V, $$160(\text{mV/° C.}) \times 35(\text{° C.}) \times 3(\text{pieces}) = 16.8(V), \text{ and}$$

in the case of Vitb=600 V, $$160(\text{mV/° C.}) \times 35(\text{° C.}) \times 4(\text{pieces}) = 22.4(V).$$

That is, the value of Vitb fluctuates depending on the ambient temperature and therefore a deviation is generated in current inflowing starting voltage V0 calculated by the discriminating function. As a result, also the applied voltage V4 (V4=V0+ΔV0>V0) in the voltage lowering function is deviated.

[Correcting Method of the Current Flowing Starting Voltage]

In the case where the potential Vitb of the intermediary transfer belt is shifted in the positive-polarity side, the current for maintaining the potential at the Zener breakdown voltage or more becomes insufficient, so that there is a liability that the applied voltage V4 (V4+V0+ΔV0>V0) in the voltage lowering function is less than the Zener breakdown voltage.

On the other hand, in the case where the potential Vitb of the intermediary transfer belt is shifted in the negative-polarity side, a current which is stronger than the current necessary to maintain the potential at the Zener breakdown voltage or more is to be passed. As a result, a useless current is passed through the outer secondary-transfer roller, so that there is a liability that a degree of the roller is hastened.

Figure 11:
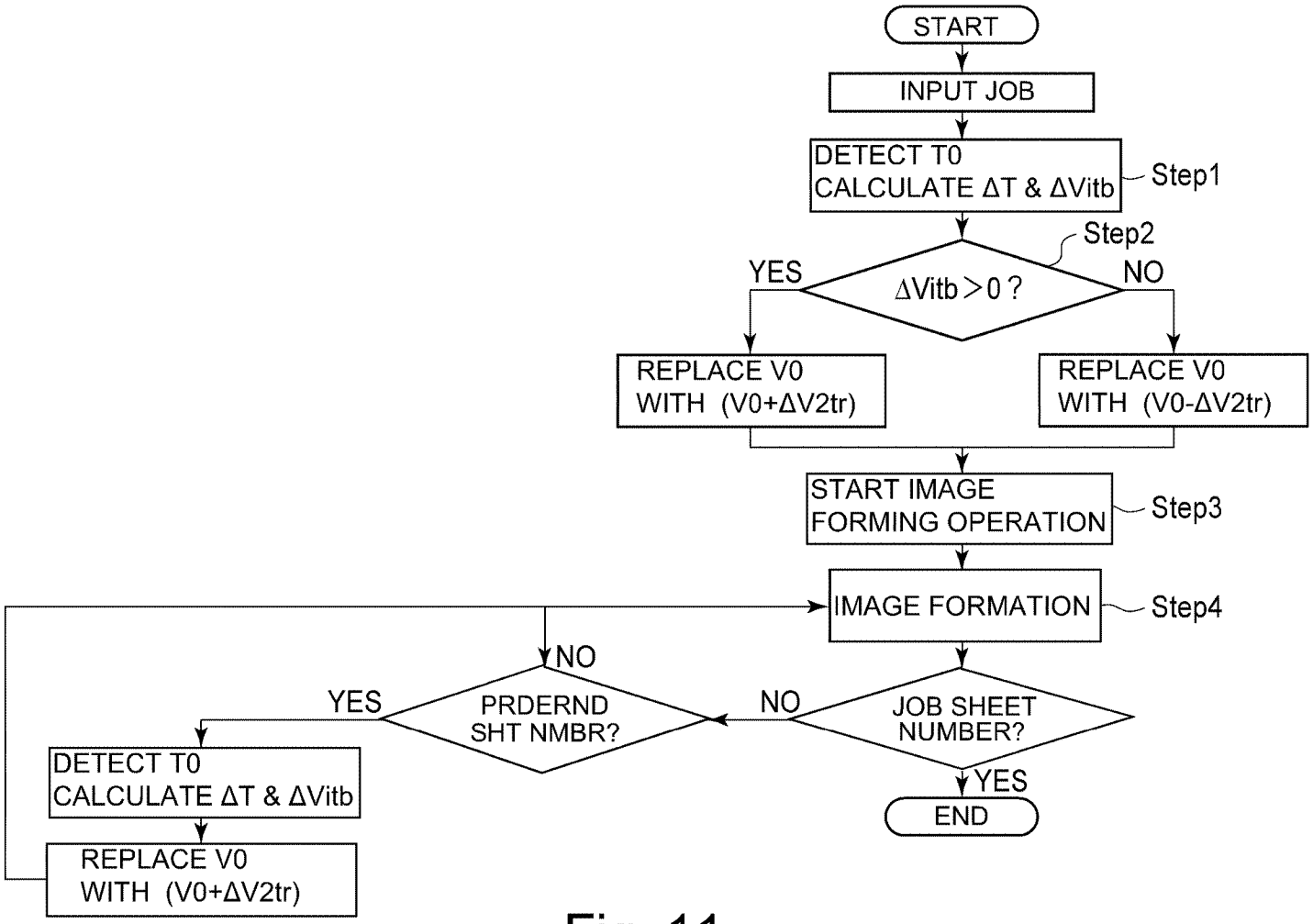
FIG. 11 is a flow chart of a correction method for a current inflowing starting voltage V0.

In the following, a correcting method of the current inflowing starting voltage V0 in this embodiment will be described. FIG. 11 shows a flowchart regarding the current inflowing starting voltage V0 correcting method in a constitution in which the discriminating function for discriminating the current inflowing starting voltage V0 only in the case where two or more ambient environments change.

First, immediately after a job is inputted from a user, the CPU circuit portion 150 (controller) detects an ambient temperature T0 in the neighborhood of the Zener diode 11 by the temperature and humidity sensor 207. At this time, from a fluctuation amount ΔT=T0−Ts of the ambient temperature, a fluctuation amount ΔVitb of Vitb is calculated. Incidentally, Ts is the ambient temperature in the neighborhood of the Zener diode 11 when the discriminating function for discriminating the current inflowing starting voltage V0 is executed at the last time, and is to be stored in the RAM in advance (Step 1). Next, the CPU circuit portion 150 discriminates a correction pattern with respect to the current inflowing starting voltage V0 from the sign of the fluctuation amount ΔVitb of Vitb (Step 2). In the case of ΔVitb<0, the current is uselessly passed correspondingly to ΔVitb, and therefore V0 is replaced with (V0−ΔV2*tr*), and the CPU circuit portion 150 starts an image forming operation (Step 3). In the case of ΔVitb>0, there arises a possibility that the applied voltage V4 (V4=V0+ΔV0>V0) is less than the Zener breakdown voltage, and therefore V0 is replaced with (V0+ΔV2*tr*), and the CPU circuit portion 150 starts the image forming operation (Step 3). Incidentally, ΔV2*tr* is the fluctuation amount, of the applied voltage at the second transfer portion, with respect to the fluctuation amount ΔVitb of the potential Vitb of the intermediary transfer belt. That is, ΔV2*tr* is the fluctuation amount, of the voltage to be applied to the outer secondary-transfer roller, necessary to fluctuate the intermediary transfer belt portion by ΔVitb. Then, the CPU circuit portion 150 detects the ambient temperature, by the temperature and humidity sensor 207, in the neighborhood of the Zener diode 11 every predetermined number of sheets in one job, and then calculates the fluctuation amount ΔVitb of Vitb from the time of last ambient temperature detection. In one job, the ambient temperature in the image forming apparatus is in a direction of rise, and therefore the CPU circuit portion 150 replaces V0 with (V0+ΔV2*tr*)m, and then continues the image forming operation (Step 4). After the image forming operation, the step returns to Step 1.

Figure 12:
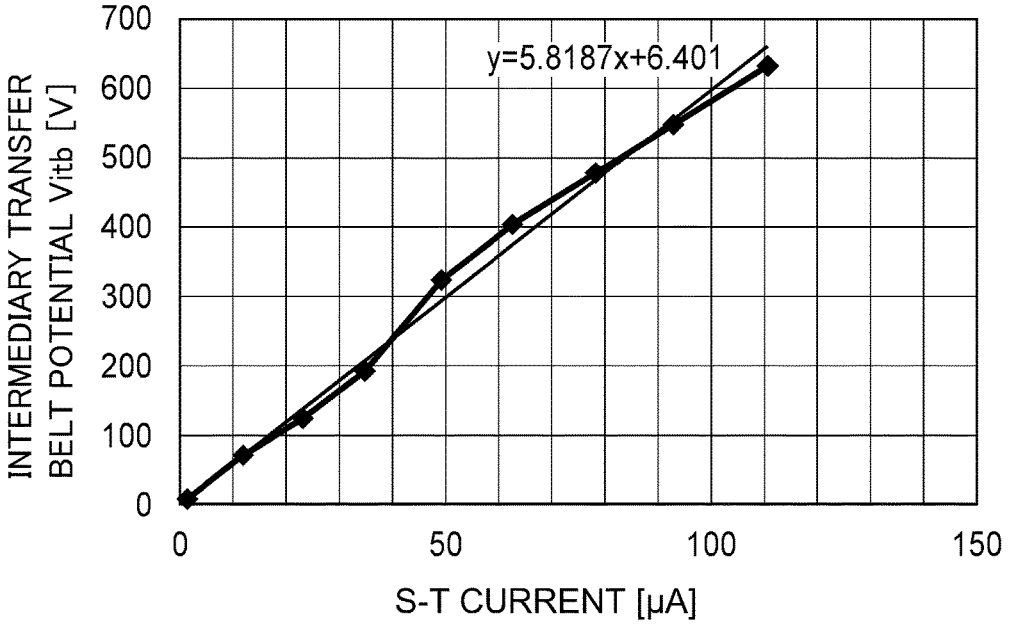
FIG. 12 is an illustration showing a relationship between a potential of an intermediary transfer belt and a secondary-transfer current.
Figure 13:
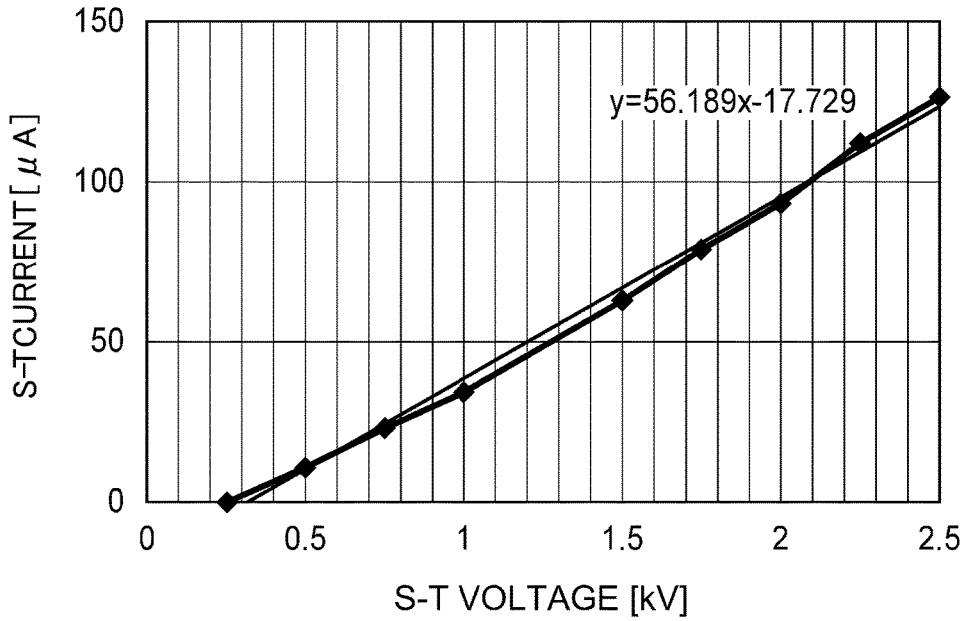
FIG. 13 is an illustration showing a relationship between the secondary-transfer current and the secondary-transfer voltage.

Next, a calculating method of the fluctuation amount ΔV2*tr* of the secondary-transfer voltage with respect to the fluctuation amount ΔVitb of the intermediary transfer belt will be described. FIG. 12 shows a relationship between the secondary-transfer current and the intermediary transfer belt potential when the charging voltage Vd during the image formation is applied to all the stations. FIG. 13 shows a relationship between the secondary-transfer current and the secondary-transfer voltage at the absolute water content of 22 (g/m$^3$). As shown in FIGS. 12 and 13, ΔVitb and ΔV2*tr* is ins a one-to-one correspondence. For that reason, when the fluctuation amount ΔVitb of the intermediary transfer belt potential Vitb due to the fluctuation in ambient temperature is calculated, it becomes possible to calculate the fluctuation amount ΔV2*tr* of the secondary-transfer voltage from FIGS. 12 and 13. There is a relation such that when the voltage applied to the outer secondary-transfer roller changes ΔV2*tr*, the intermediary transfer belt potential changes by ΔVitb. Incidentally, the charging voltage applied to each station during the image formation is different between a full-color mode and a Bk single-color mode, and therefore a relationship between the secondary-transfer current and the intermediary transfer belt potential in different environments is stored every mode in the ROM 151. Further, with respect to the relationship between the secondary-transfer current and the secondary-transfer voltage data in the last execution of the ATVC is held in the RAM and then is called up by the CPU.

By the above, it becomes possible to calculate the fluctuation amount ΔV2*tr* of the secondary-transfer voltage with respect to the fluctuation amount ΔVitb of the intermediary transfer belt potential Vitb.

Then, a current inflowing starting voltage V0 correcting method in a constitution in which the discriminating function for discriminating the current inflowing starting voltage V0 is always executed during pre-rotation control will be described. In this case, with respect to the fluctuation intermediary transfer belt potential, the discriminating function for discriminating the current inflowing starting voltage V0 is executed, and therefore correction of the current inflowing starting voltage V0 before the image forming operation is not needed.

Further, when the number of sheets of the recording material on which the image is formed in one job is large, the temperature inside the apparatus gradually increases. As a result, due to the temperature characteristic of the Zener diode, when the fluctuation in potential of the intermediary transfer member becomes large, there is a liability that the fluctuation exerts the influence on the primary-transfer. As a result, there is a liability that a fluctuation in color tint is generated between images to be formed in the same job. Therefore, the CPU circuit portion 150 detects the ambient temperature, by the temperature and humidity sensor 207, in the neighborhood of the Zener diode 11 every predetermined number of sheets in one job, and then calculates the fluctuation amount ΔVitb of Vitb from the last ambient temperature detection. In one job, the ambient temperature in the image forming apparatus is in a direction of rise, and therefore the CPU circuit portion 150 replaces V0 with (V0+ΔV2*tr*) and thereafter continues the image forming operation.

To put the above correction collectively in other words, the CPU circuit portion 150 (control means) controls an absolute value of the voltage, applied to the outer secondary-transfer roller (transfer member) when a detected temperature of the temperature and humidity sensor 207 (temperature detecting member) is a first temperature, so as to be higher than an absolute value of the voltage applied to the outer secondary-transfer roller when the detected temperature is a second temperature lower than the first temperature.

As described above, in this embodiment, in order to suppress the long downtime, even when the ATVC or the voltage lowering function when no recording material exists at the secondary-transfer portion is carried out in parallel with the primary-transfer, the voltage drop of the Zener diode is made not less than the Zener breakdown voltage. For that reason, it is possible to suppress that the primary-transfer becomes unstable.

Incidentally, in this embodiment, a constitution in which the image portion potential is changed depending on the temperature characteristic of the Zener diode is employed, and therefore this embodiment is particularly effective in a constitution in which an inexpensive Zener diode such that a temperature characteristic thereof is large is used. Of course, the present invention is not intended to be limited to the constitution in which the inexpensive Zener diode such that the temperature characteristic thereof is large is used. This embodiment is also applicable to a constitution in which a Zener diode showing a small temperature change in Zener breakdown voltage Vbr is used.

Incidentally, in this embodiment, a constitution in which the temperature and humidity sensor 207 is disposed as the temperature detecting member for detecting information corresponding to the temperature of the Zener diode 11 is employed. Of course, this embodiment is not limited to this constitution.

It is also possible to employ a constitution in which the information corresponding to the temperature of the Zener diode 11 is detected by counting the number of sheets of the recording material on which the image is formed by a single image forming job.

Further, it is also possible to employ a constitution in which the information corresponding to the temperature of the Zener diode 11 is detected on the basis of the relationship between the current passing through the secondary-transfer portion and the voltage applied to the secondary-transfer roller.

Or, it is also possible to employ a constitution in which the information corresponding to the temperature of the Zener diode 11 is detected on the basis of an energization period of the image forming apparatus.

Incidentally, in this embodiment, the constitution in which the applied voltage is changed depending on the temperature characteristic of the Zener diode is employed, and therefore it is possible to suppress that the voltage applied to the Zener diode is less than the Zener breakdown voltage due to the temperature characteristic of the Zener diode itself. Further, it is desirable that even when the intermediary transfer belt potential is changed due to the temperature characteristic of the Zener diode itself, it is possible to suppress the influence on the primary-transfer defect. Therefore, it is also possible to employ a constitution in which the image portion potential is changed depending on the temperature characteristic of the Zener diode. That is, it is also possible to employ a constitution in which the applied voltage is changed depending on the temperature characteristic of the Zener diode, and at the same time also the image portion potential is changed.

Incidentally, in this embodiment, the image forming apparatus for forming the electrostatic image by the electrophotographic type is described, but this embodiment is not limited to this constitution. It is also possible to use an image forming apparatus for forming the electrostatic image by an electrostatic force type, not the electrophotographic type.

INDUSTRIAL APPLICABILITY

According to the present invention, in the constitution in which the predetermined voltage is generated in the intermediary transfer member by the constant-voltage element, it is possible to avoid the transfer defect capable of generating in the case where the timing of the primary-transfer and the timing of application of the voltage to the transfer member overlap with each other.

The invention claimed is:

1. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential and configured to maintain a predetermined voltage by passing of a current therethrough, said constant-voltage element comprising a Zener diode or a varistor;

a power source configured to form both of a secondary-transfer electric field at the secondary-transfer position and a primary-transfer electric field at the primary transfer position by applying a voltage to the transfer member to pass the current through the constant-voltage element;

a detecting portion configured to detect the current passing through the transfer member;

an executing portion configured to execute a test mode in which a test voltage is applied to the transfer member by the power source to detect the current by the detecting portion when no recording material exists at the secondary-transfer position; and a controller configured to control a voltage to be applied to the transfer member by the power source when the recording material exists at the secondary-transfer position, on the basis of the current detected by the detecting portion in the test mode, wherein the constant-voltage element maintains the predetermined voltage in at least an overlapping period where a period of the test mode and a period in which the toner image to be transferred onto the recording material is transferred at the primary-transfer position overlap with each other.

2. An image forming apparatus according to claim 1, wherein the constant-voltage element is a Zener diode and the predetermined voltage is a breakdown voltage of the Zener diode.

3. An image forming apparatus according to claim 1, wherein the voltage applied to the transfer member by the power source controlled by the controller includes a voltage lower than a voltage for forming the secondary-transfer electric field.

4. An image forming apparatus according to claim 1, wherein in a non-overlapping period where the period of the test mode and the period in which the toner image to be transferred onto the recording material is transferred at the primary-transfer position do not overlap with each other in the test mode, the controller controls the voltage applied to the transfer member in the non-overlapping period so as to be less than a voltage at which the constant-voltage element forms the predetermined voltage.

5. An image forming apparatus according to claim 1, wherein the detecting portion is a first detecting portion, the image forming apparatus comprises a second detecting portion configured to detect the current passing through the constant-voltage element, the executing portion carries out detection at the second detecting portion by applying a voltage to the transfer member at timing before the toner image to be transferred onto the recording material is primary-transferred, and the controller controls the power source on the basis of a detection result of the second detecting portion in order to set the voltage to be applied to the transfer member so that the constant-voltage element maintains the predetermined voltage.

6. An image forming apparatus according to claim 5, wherein the executing portion carries out the detection at the second detecting portion in the period of the test mode.

7. An image forming apparatus according to claim 1, wherein the executing portion executes the test mode when a region of the intermediary transfer member corresponding to a region between the recording material and a recording material following the recording material in the case where images are continuously formed, is in the secondary-transfer position.

8. An image forming apparatus according to claim 1, wherein the intermediary transfer member has a structure of two layers or more, and a volume resistivity of the layer in the outer peripheral surface side is higher than a volume resistivity of the layer in an inner peripheral surface side.

9. An image forming apparatus according to claim 1, wherein the intermediary transfer member is an intermediary transfer belt, and the image forming apparatus comprises a plurality of stretching members configured to stretch the intermediary transfer belt in contact with an inner peripheral surface of the intermediary transfer belt.

10. An image forming apparatus according to claim 9, wherein the stretching members are stretching rollers having electroconductivity, and the stretching rollers are electrically connected with the constant-voltage element to electrically connect the intermediary transfer member with the constant-voltage element.

11. An image forming apparatus according to claim 1, further comprising a temperature detecting member configured to detect a temperature in the neighborhood of the constant-voltage element, wherein the controller controls the power source on the basis of a detection result of the temperature detecting member.

12. An image forming apparatus according to claim 11, wherein the controller controls an absolute value of the voltage to be applied to the transfer member when a detected temperature of the temperature detecting member is a first temperature, so as to be higher than an absolute value of the voltage to be applied to the transfer member when the detected temperature detecting member is a second temperature lower than the first temperature.

13. An image forming apparatus comprising:

an image bearing member configured to bear a toner image;

an intermediary transfer member configured to carry the toner image transferred from the image bearing member at a primary-transfer position;

a transfer member provided contactable to an outer peripheral surface of the intermediary transfer member and configured to transfer the toner image from the intermediary transfer member onto a recording material at a secondary-transfer position;

a constant-voltage element electrically connected between the intermediary transfer member and a ground potential, and configured to maintain a predetermined voltage by passing of a current therethrough;

a power source configured to form both of a secondary-transfer electric field at the secondary-transfer position and a primary-transfer electric field at the primary-transfer position by applying a voltage to the transfer member to pass the current through the constant-voltage element;

a detecting portion configured to detect the voltage applied to the transfer member;

an executing portion configured to execute a test mode in which a test current is passed through the transfer member by the power source to detect the voltage by the detecting portion when no recording material exists at the secondary-transfer position; and a controller configured to control a voltage to be applied to the transfer member by the power source when the recording material exists at the secondary-transfer position on the basis of the voltage detected by the detecting portion in the test mode, wherein the constant-voltage element maintains the predetermined voltage in at least an overlapping period where a period of the test mode and a period in which the toner image to be transferred onto the recording material is transferred at the primary-transfer position overlap with each other.

* * * * *